US011486028B2

(12) United States Patent
Nagano et al.

(10) Patent No.: US 11,486,028 B2
(45) Date of Patent: Nov. 1, 2022

(54) HIGH-STRENGTH STEEL SHEET

(71) Applicant: NIPPON STEEL CORPORATION, Tokyo (JP)

(72) Inventors: Mai Nagano, Tokyo (JP); Koutarou Hayashi, Tokyo (JP); Akihiro Uenishi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 80 days.

(21) Appl. No.: 17/054,467

(22) PCT Filed: Jul. 26, 2019

(86) PCT No.: PCT/JP2019/029432

§ 371 (c)(1),
(2) Date: Nov. 10, 2020

(87) PCT Pub. No.: WO2020/022481

PCT Pub. Date: Jan. 30, 2020

(65) Prior Publication Data

US 2021/0164082 A1 Jun. 3, 2021

(30) Foreign Application Priority Data

Jul. 27, 2018 (JP) ..... JP2018-141244

(51) Int. Cl.
*C22C 38/58* (2006.01)
*C22C 38/02* (2006.01)
(Continued)

(52) U.S. Cl.
CPC ..... *C22C 38/58* (2013.01); *C21D 8/02* (2013.01); *C21D 9/46* (2013.01); *C22C 38/02* (2013.01);
(Continued)

(58) Field of Classification Search
None
See application file for complete search history.

(56) References Cited

U.S. PATENT DOCUMENTS

2004/0069382 A1 4/2004 Yokoi et al.
2017/0009315 A1 1/2017 Shibata et al.

FOREIGN PATENT DOCUMENTS

CN 106029928 A 10/2016
EP 1 391 526 B2 6/2014
(Continued)

OTHER PUBLICATIONS

"Metallic materials—Tensile testing—Method of test at room temperature", JIS Z 2241, 2011, total 37 pages.
(Continued)

*Primary Examiner* — Anthony M Liang
(74) *Attorney, Agent, or Firm* — Birch, Stewart, Kolasch & Birch, LLP

(57) ABSTRACT

What is provided is a high-strength steel sheet having a large bake hardening amount and a uniform bake hardenability is provided according to the present invention, the high-strength steel sheet comprising, by mass %: C: 0.13% to 0.40%; Si: 0.500% to 3.000%; Mn: 2.50% to 5.00%; P: 0.100% or less; S: 0.010% or less; Al: 0.001% to 2.000%; N: 0.010% or less; and a remainder consisting of Fe and impurities, wherein martensite is 95% or more in an area ratio, and residual structure is 5% or less in an area ratio, a ratio C1/C2 of an upper limit C1 (mass %) of Si concentrations to a lower limit C2 (mass %) of the Si concentrations in a cross section in a thickness direction is 1.25 or less, precipitates having a major axis of 0.05 μm or more and 1.00 μm or less and an aspect ratio of 1:3 or more are included in a number density of 30/μm$^2$ or more, and a tensile strength is 1300 MPa or more.

8 Claims, 1 Drawing Sheet

(51) Int. Cl.

| | |
|---|---|
| ***C21D 8/02*** | (2006.01) |
| ***C21D 9/46*** | (2006.01) |
| *C22C 38/06* | (2006.01) |

(52) U.S. Cl.
CPC .... *C21D 2201/00* (2013.01); *C21D 2211/008* (2013.01); *C22C 38/06* (2013.01); *C22C 2202/00* (2013.01)

(56) References Cited

FOREIGN PATENT DOCUMENTS

| | | | |
|---|---|---|---|
| JP | 3927384 | B2 | 6/2007 |
| JP | 2008-144233 | A | 6/2008 |
| JP | 2016-191125 | A | 11/2016 |

OTHER PUBLICATIONS

Kuang et al., "Effect of Temper Rolling on the Bake-Hardening Behavior of Low Carbon Steel", International Journal of Minerals, Metallurgy and Materials, Jan. 2015, vol. 22, No. 1, pp. 32-36.
Kumagai, "The Effect of Prestrain on the Strain-Aging of Mild Steel", Proceedings of the Japan Society of Mechanical Engineers, 1979, vol. 45, pp. 983-989.
Nakaoka et al., "Strength, Ductility and Aging Properties of Continuously-Annealed Dual-Phase High-Strength Sheet Steels", Formable HSLA and Dual-Phase Steels, Metall. Soc. of AIME, 1977, pp. 126-141.
"High-Strength Electrical-Resistance-Welded Steel Pipe and Manufacturing Method Therefor," JFE Steef Corporation, Form 2, Complete Specification, Jun. 7, 2013, 50 pages total.

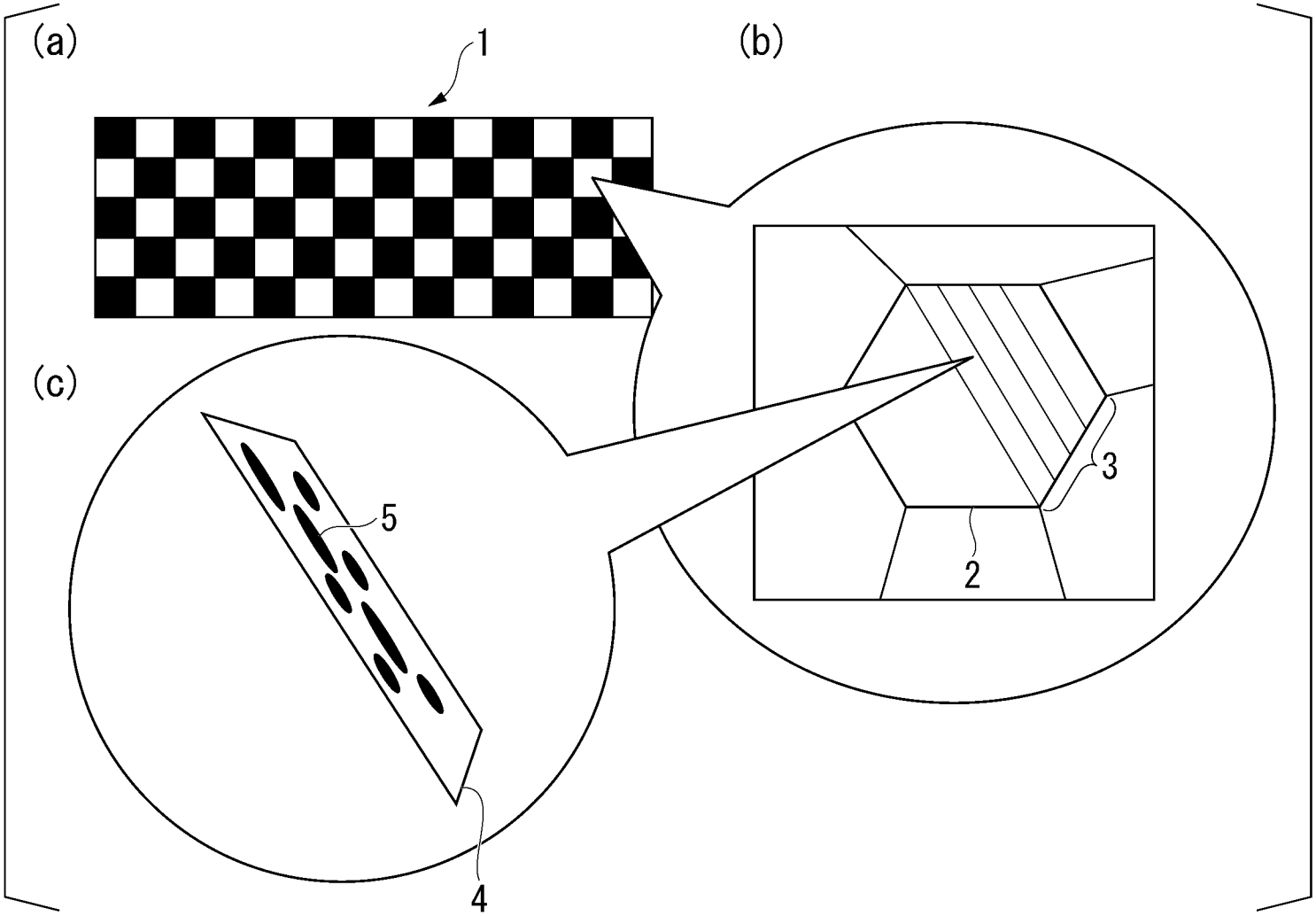
(a)
(b)
(c)
1
2
3
4
5

HIGH-STRENGTH STEEL SHEET

TECHNICAL FIELD OF THE INVENTION

The present invention relates to a high-strength steel sheet, and particularly to a high-strength steel sheet which has a tensile strength of 1300 MPa or more, is suitable for a structural member of a vehicle and the like, which is mainly press-formed to be used, and has excellent bake hardenability.

Priority is claimed on Japanese Patent Application No. 2018-141244, filed Jul. 27, 2018, the content of which is incorporated herein by reference.

RELATED ART

In recent years, for global environmental protection, there is a demand for an improvement in the fuel efficiency of a vehicle, and for a reduction in the weight of the vehicle body and securing safety, there is a demand for further high-strengthening in a vehicle steel sheet. In the case of high-strengthening of a steel sheet, the ductility generally decreases, so that it is difficult to perform cold press forming. Therefore, there is a demand for a material that is relatively soft and is likely to be formed during forming and has high strength after the forming, that is, a material having a high bake hardening amount.

The bake hardening is a strain aging phenomenon that occurs when interstitial elements (carbon or nitrogen) diffuse into dislocations formed by press forming (hereinafter, also referred to as "prestrain") during baking for coating at 150° C. to 200° C. and lock the dislocations.

As shown in Non-Patent Document 1, the bake hardening amount depends on the amount of interstitial solid solution element, that is, the amount of solid solution carbon. Therefore, in martensite, which has a larger amount of solid solution carbon than ferrite, which has a small amount of solid solution carbon, the bake hardening amount increases. In this regard, for example, Patent Document 1 discloses a high-strength steel sheet primarily containing bainite and martensite. In the high-strength steel sheet disclosed in Patent Document 1, a steel material is heated to be in a temperature range of the $Ac_3$ point or higher and thereafter subjected to a predetermined treatment to increase the dislocation density and improve bake hardenability.

On the other hand, the strain amount introduced by press forming generally differs depending on the specific conditions and location of a molding step. Therefore, in order to reliably improve the bake hardenability of a steel sheet even if there is a difference in the strain amount, it is necessary to uniformly develop bake hardening by the same amount at any strain amount. For this, it is important to perform evaluation not only by the bake hardening amount by a single prestrain but also by the bake hardening amount by a plurality of prestrains and to manufacture a material in which the prestrain dependence of the bake hardening amount is small.

However, in Patent Document 1, since only the bake hardening amount in the case of a prestrain of 1% is disclosed in the examples, the bake hardening amount in the case of other prestrain amounts is unknown. As a control factor for the bake hardening amount, a dislocation density is also important. However, as shown in Non-Patent Documents 2 and 3, when the dislocation density is too high, there are cases where the amount of carbon segregated per unit dislocation length is reduced or moving dislocations are reduced due to the interaction between dislocations. Therefore, as in Patent Document 1, there are cases where simply increasing the dislocation density increases the prestrain dependence of the bake hardening amount, and as a result, reduces the bake hardening amount.

As described above, among steel sheets having excellent bake hardenability, it is difficult to achieve both (1) a large bake hardening amount and (2) small prestrain dependence of the bake hardening amount (hereinafter, referred to as "high uniform bake hardenability").

PRIOR ART DOCUMENT

Patent Document

[Patent Document 1] Japanese Unexamined Patent Application, First Publication No. 2008-144233

Non-Patent Document

[Non-Patent Document 1] K. Nakaoka, et al., "Strength, Ductility and Aging Properties of Continuously-Annealed Dual-Phase High Strength Sheet Steels", Formable HSLA and Dual-Phase Steels, Metall. Soc. of AIME, (1977) 126-141

[Non-Patent Document 2] C. Kuang, et al., "Effect of Temper Rolling on the Bake-Hardening Behavior of Low Carbon Steel", International Journal of Minerals, Metallurgy and Materials, 22 (2015) 32-36

[Non-Patent Document 3] Kazuo Kumagai, "The Effect of Prestrain on the Strain-Aging of Mild Steel", Transactions of the Japan Society of Mechanical Engineers, 45 (1979) 983-989.

DISCLOSURE OF THE INVENTION

Problems to be Solved by the Invention

In order to meet the demand for further high-strengthening in the future, excellent bake hardenability has to be secured. The excellent bake hardenability mentioned here means (1) a large bake hardening amount and (2) high uniform bake hardenability. However, in an ordinary structure having martensite as a primary phase, it is difficult to achieve both (1) and (2) as in Patent Document 1.

Therefore, an object of the present invention is to provide a high-strength steel sheet having a large bake hardening amount and high uniform bake hardenability.

Means for Solving the Problem

The present inventors considered that in order to achieve the above object, attention should not be paid to the amount of solid solution carbon and the dislocation density. This is because a sufficient amount of solid solution carbon is present in martensite, and uniform bake hardenability cannot be secured as in Patent Document 1 with control of the dislocation density. Therefore, the present inventors considered that it is important to pay attention to the dislocation formation behavior in which bake hardening is likely to occur.

Dislocations generally refer to linear crystal defects. For example, when they are entangled with each other and form dislocation cells, the dislocations alone become immobilized. In such a case, the amount of dislocations that are locked due to carbon or the like that diffuses during bake hardening decreases, and as a result, the bake hardening amount decreases. In general, the case with which dislocation cells are generated depends on the prestrain amount, and therefore the bake hardening amount fluctuates greatly depending on the prestrain amount. Therefore, the present inventors considered that the bake hardenability can be improved by suppressing the formation of dislocation cells, and conducted intensive research.

As a result, the present inventors found that the formation of dislocation cells can be suppressed by precipitating a large amount of precipitates which are finer than the sizes of cells to be formed, for example, iron carbide. The present inventors considered that this may improve the bake hardenability, but there was a problem that precipitation of precipitates such as iron carbide causes a non-uniform hardness difference to occur in the structure and rather promotes the formation of dislocation cells.

This non-uniform hardness difference is caused by precipitation hardening due to non-uniform precipitation of precipitates. The present inventors found that such non-uniform precipitation occurs due to microsegregation, and more specifically, due to microsegregation of Si necessary for precipitation of precipitates. In general, microsegregation is a phenomenon in which the concentrations of alloying elements generated during solidification are non-uniformly distributed, and planes perpendicular to a plate thickness direction are continuous in layers.

Therefore, the present inventors found that by controlling a hot rolling step to suppress microsegregation of Si by forming a complex shape and a uniform structure (hereinafter, uniform structure) and uniformly precipitating a large amount of fine precipitates such as iron carbide, bake hardenability is greatly improved.

A high-strength steel sheet having excellent bake hardenability of the present invention which has achieved the above-mentioned object in this way is as follows.

(1) A high-strength steel sheet including, by mass %:

C: 0.13% to 0.40%;

Si: 0.500% to 3.000%;

Mn: 2.50% to 5.00%;

P: 0.100% or less;

S: 0.010% or less;

Al: 0.001% to 2.000%;

N: 0.010% or less; and a remainder including of Fe and impurities, wherein a martensite is 95% or more in an area ratio, and a residual structure is 5% or less in an area ratio, a ratio C1/C2 of an upper limit C1 (mass %) of Si concentrations to a lower limit C2 (mass %) of the Si concentrations in a cross section in a thickness direction is 1.25 or less, precipitates having a major axis of 0.05 μm or more and 1.00 μm or less and an aspect ratio of 1:3 or more are included in a number density of 30/μm$^2$ or more, and a tensile strength is 1300 MPa or more.

(2) The high-strength steel sheet according to (1), in which, in a case where the residual structure is present, the residual structure is formed of residual austenite.

(3) The high-strength steel sheet according to (1) or (2), further including, by mass %, one or two or more selected from the group consisting of:

Ti: 0.100% or less;

Nb: 0.100% or less; and

V: 0.100% or less, in a total amount of 0.100% or less.

(4) The high-strength steel sheet according to any one of (1) to (3), further including, by mass %, one or two or more selected from the group consisting of:

Cu: 1.000% or less;

Ni: 1.000% or less;

Mo: 1.000% or less; and

Cr: 1.000% or less, in a total amount of 1.000% or less.

(5) The high-strength steel sheet according to any one of (1) to (4), further including, by mass %, one or two or more selected from the group consisting of:

W: 0.005% or less;

Ca: 0.005% or less;

Mg: 0.005% or less; and a rare earth metal (REM): 0.010% or less, in a total amount of 0.010% or less.

(6) The high-strength steel sheet according to any one of (1) to (5), further including, by mass %: B: 0.0030% or less.

Effects of the Invention

According to the present invention, it is possible to provide a high-strength steel sheet having excellent bake hardenability by preventing the formation of dislocation cells by forming a structure having uniform Si microsegregation and allowing specific precipitates to be developed on the entire surface of the lath in martensite by a heat treatment at a certain temperature, and allowing carbon to efficiently diffuse into dislocations to lock the dislocations. The high-strength steel sheet is subjected to further high-strengthening by being baked during coating after press forming and is thus suitable in a structural field such as an automotive field.

BRIEF DESCRIPTION OF THE DRAWINGS

FIG. 1 is an image diagram showing a precipitation state of precipitates in a high-strength steel sheet according to the present invention.

EMBODIMENTS OF THE INVENTION

<High-Strength Steel Sheet>

A high-strength steel sheet according to an embodiment of the present invention includes, by mass %:

C: 0.13% to 0.40%;

Si: 0.500% to 3.000%;

Mn: 2.50% to 5.00%;

P: 0.100% or less;

S: 0.010% or less;

Al: 0.001% to 2.000%;

N: 0.010% or less; and a remainder consisting of Fe and impurities, in which the high-strength steel sheet contains martensite in an area ratio of 95% or more, and a residual structure in an area ratio of 5% or less, a ratio C1/C2 of an upper limit C1 (mass %) of Si concentrations to a lower limit C2 (mass %) of the Si concentrations in a cross section in a thickness direction is 1.25 or less, precipitates having a major axis of 0.05 μm or more and 1.00 μm or less and an aspect ratio of 1:3 or more are included in a number density of 30/μm$^2$ or more, and a tensile strength is 1300 MPa or more.

First, the chemical composition of the high-strength steel sheet according to the embodiment of the present invention and a slab used for the manufacturing thereof will be described. In the following description, "%", which is the unit of the amount of each element contained in the high-strength steel sheet and the slab, means "mass %" unless otherwise specified.

(C: 0.13% to 0.40%)

C has an action of increasing the amount of solid solution carbon and enhancing bake hardenability. In addition, C has an action of enhancing hardenability and increasing strength by being contained in a martensite structure. When the C content is less than 0.13%, a sufficient amount of solid solution carbon cannot be secured when carbides such as iron carbide are precipitated, and a bake hardening amount decreases. Therefore, the C content is set to 0.13% or more, preferably 0.16% or more, and more preferably 0.20% or more. On the other hand, when the C content is more than 0.40%, incomplete martensitic transformation occurs in cooling after annealing, and the fraction of residual austenite increases, which is outside the embodiment of the present invention. In addition, the strength is too high to secure formability. Therefore, the C content is set to 0.40% or less, and preferably 0.35% or less.

(Si: 0.500% to 3.000%)

Si is an element necessary for precipitating a large amount of fine precipitates such as iron carbide for suppressing dislocation cells. When the Si content is less than 0.500%, even if the segregation has occurred in a uniform structure, a sufficient action and effect cannot be obtained, and coarse precipitates are generated, so that formation of dislocation cells cannot be suppressed. Therefore, the Si content is set to 0.500% or more, and preferably 1.000% or more. On the other hand, when the Si content exceeds 3.000%, the effect of precipitating a large amount of fine precipitates is saturated, resulting in an unnecessary increase in cost and deterioration of surface properties. Therefore, the Si content is set to 3.000% or less, and preferably 2.000% or less.

(Mn: 2.50% to 5.00%)

Mn is an element that improves hardenability and is an element necessary for forming a martensite structure without limiting a cooling rate. In order to effectively exhibit this action, the Mn content is set to 2.50% or more, and preferably 3.00% or more. However, since excessive inclusion of Mn reduces low temperature toughness due to the precipitation of MnS, the Mn content is set to 5.00% or less, and preferably 4.50% or less.

(P: 0.100% or Less)

P is not an essential element, but is contained, for example, as an impurity in steel. From the viewpoint of weldability, the lower the P content, the better. In particular, when the P content is more than 0.100%, a reduction in weldability is significant. Therefore, the P content is set to 0.100% or less, and preferably 0.030% or less. It costs money to reduce the P content, and a reduction in the P content to less than 0.0001% causes a significant increase in the cost. Therefore, the P content may be set to 0.0001% or more. Furthermore, since P contributes to an improvement in strength, the P content may be set to 0.0001% or more from such a viewpoint.

(S: 0.010% or Less)

S is not an essential element, but is contained, for example, as an impurity in steel. From the viewpoint of weldability, the lower the S content, the better. As the S content increases, the amount of MnS precipitated increases, and the low temperature toughness decreases. In particular, when the S content is more than 0.010%, a reduction in the weldability and a reduction in the low temperature toughness are significant. Therefore, the S content is set to 0.010% or less, and preferably 0.003% or less. It costs money to reduce the S content, and a reduction in the S content to less than 0.0001% causes a significant increase in the cost. Therefore, the S content may be set to 0.0001% or more.

(Al: 0.001% to 2.000%)

Al has an effect on deoxidation. In order to effectively exhibit the above action, the Al content is set to 0.001% or more, and preferably 0.010% or more. On the other hand, when the Al content is more than 2.000%, the weldability decreases or oxide-based inclusions are increased in amount, resulting in the deterioration of surface properties. Therefore, the Al content is set to 2.000% or less, and preferably 1.000% or less.

(N: 0.010% or Less)

N is not an essential element, but is contained, for example, as an impurity in steel. From the viewpoint of weldability, the lower the N content, the better. In particular, when the N content is more than 0.010%, a reduction in the weldability is significant. Therefore, the N content is set to 0.010% or less, and preferably 0.006% or less. It costs money to reduce the N content, and a reduction in the N content to less than 0.0001% causes a significant increase in the cost. Therefore, the N content may be set to 0.0001% or more.

The basic composition of the high-strength steel sheet of the present invention and the slab used for the manufacturing thereof is as described above. Furthermore, the high-strength steel sheet of the present invention and the slab used for the manufacturing thereof may contain the following optional elements, as necessary.

(Ti: 0.100% or Less, Nb: 0.100% or Less, and V: 0.100% or Less)

Ti, Nb, and V contribute to an improvement in strength. Therefore, Ti, Nb, V, or any combination thereof may be contained. In order to sufficiently obtain this effect, the amount of Ti, Nb, or V, or the total amount of any combination of two or more thereof is preferably set to 0.003% or more. On the other hand, when the amount of Ti, Nb, or V or the total amount of any combination of two or more thereof is more than 0.100%, it becomes difficult to perform hot rolling and cold rolling. Therefore, the Ti content, the Nb content, the V content, or the total amount of any combination of two or more thereof is set to 0.100% or less. That is, it is preferable that the limit range in the case of including each element alone is set to Ti: 0.003% to 0.100%, Nb: 0.003% to 0.100%, and V: 0.003% to 0.100%, and the total amount thereof in the case of any combination thereof is also set to 0.003% to 0.100%.

(Cu: 1.000% or Less, Ni: 1.000% or Less, Mo: 1.000% or Less, and Cr: 1.000% or Less)

Cu, Ni, Mo, and Cr contribute to an improvement in strength. Therefore, Cu, Ni, Mo, Cr, or any combination thereof may be contained. In order to sufficiently obtain this effect, the amount of Cu, Ni, Mo, and Cr is preferably in a range of 0.005% to 1.000% in the case of including each element alone, and the total amount thereof in the case of any combination of two or more thereof preferably satisfies 0.005% or more and 1.000% or less. On the other hand, when the amount of Cu, Ni, Mo, and Cr or the total amount in the case of any combination of two or more thereof is more than 1.000%, the effect due to the above-mentioned action is saturated and causes an increase in the cost. Therefore, the upper limit of the amount of Cu, Ni, Mo, and Cr or the total amount in the case of any combination of two or more thereof is set to 1.000%. That is, it is preferable that Cu: 0.005% to 1.00%, Ni: 0.005% to 1.000%, Mo: 0.005% to 1.000%, and Cr: 0.005% to 1.000% are set, and the total amount in the case of any combination thereof is 0.005% to 1.000%.

(W: 0.005% or Less, Ca: 0.005% or Less, Mg: 0.005% or Less, and REM: 0.010% or Less)

W, Ca, Mg, and REM contribute to the fine dispersion of inclusions and enhance toughness. Therefore, W, Ca, Mg, or REM or any combination thereof may be contained. In order to sufficiently obtain this effect, the total amount of W, Ca, Mg, and REM, or any combination of two or more thereof is preferably set to 0.0003% or more. On the other hand, when the total amount of W, Ca, Mg, and REM is more than 0.010%, the surface properties deteriorate. Therefore, the total amount of W, Ca, Mg, and REM is set to 0.010% or less. That is, it is preferable that W be 0.005% or less, Ca be 0.005% or less, Mg be 0.005% or less, and REM be 0.010% or less are set, and the total amount of any two or more thereof is 0.0003% to 0.010%.

REM (rare earth metal) refers to a total of 17 elements including Sc, Y, and lanthanoids, and "REM content" means the total amount of these 17 elements. Lanthanoids are added industrially, for example, in the form of mischmetal.

(B: 0.0030% or Less)

B is an element that improves hardenability and is an element useful for forming a martensite structure. The B content may be 0.0001% (1 ppm) or more. However, when The B content may be more than 0.0030% (30 ppm), the above effect is saturated and it is economically useless. Therefore, the B content is set to 0.0030% or less. The B content is preferably 0.0025% or less.

In the high-strength steel sheet according to the present embodiment, the remainder other than the above elements includes Fe and impurities. Here, the impurities are elements that are incorporated in due to various factors in a manufacturing process, including raw materials such as ores and scraps, when industrially manufacturing the high-strength steel sheet, and are not intentionally added to the high-strength steel sheet according to the present embodiment.

Next, the structure of the high-strength steel sheet according to the embodiment of the present invention will be described. Hereinafter, structure requirements will be described, but % relating to a microstructural fraction means "area ratio".

(Martensite: 95% or More)

The present embodiment is characterized in that martensite is secured in an area ratio of 95% or more. Accordingly, a sufficient amount of solid solution carbon can be secured, and as a result, bake hardenability can be enhanced. In order to further enhance such an effect, it is recommended that martensite is secured in an area ratio of 97% or more, such as, for example, 100%.

In the present invention, the area ratio of martensite is determined as follows. First, a sample is taken with a plate thickness cross section perpendicular to a rolling direction of a steel sheet as an observed section, the observed section is polished, the structure thereof at a thickness ¼ position of the steel sheet is observed with a scanning electron microscope with an electron backscatter diffractometer (SEM-EBSD) at a magnification of 5,000-fold, the resultant is subjected to image analysis in a visual field of 100 μm×100 μm to measure the area ratio of martensite, and the average of values measured at any five or more visual fields is determined as the area ratio of martensite in the present invention.

(Residual Structure: 5% or Less)

According to the present invention, the residual structure other than martensite has an area ratio of 5% or less. In order to further enhance the bake hardenability of the high-strength steel sheet, the area ratio thereof is preferably set to 3% or less, and more preferably 0%. In a case where the residual structure is present, the residual structure can include any structure and is not particularly limited, but it is preferable that the residual structure, for example, includes residual austenite or consists of residual austenite. There are cases where the generation of a small amount of residual austenite is unavoidable depending on the elements of the steel and manufacturing method. However, such a small amount of residual austenite does not adversely affect the bake hardenability, and can also contribute to an improvement in ductility by a transformation induced plasticity (TRIP) effect when subjected to deformation. Therefore, the residual structure may contain residual austenite in an area ratio range of 5% or less. However, in order to further enhance the bake hardenability, the amount of residual austenite is preferably set to 3% or less, and more preferably 0%.

In the present invention, the area ratio of residual austenite is determined by an X-ray diffraction measurement. Specifically, a portion from the surface of the steel sheet to the thickness ¼ position of the steel sheet is removed by mechanical polishing and chemical polishing, and the X-ray diffraction intensity at a depth ¼ position from the surface of the steel sheet is measured using MoKa radiation as a characteristic X-ray. Then, from the integrated intensity ratios between the diffraction peaks of (200) and (211) of a body-centered cubic lattice (bcc) phase and (200), (220), and (311) of a face-centered cubic lattice (fcc) phase, the area ratio of residual austenite is calculated by using the following formula.

$$S\gamma=(I_{200\gamma}+I_{220\gamma}+I_{311\gamma})/(I_{200b}+I_{211b})\times 100$$

In the above formula, Sγ represents the area ratio of residual austenite, $I_{200\gamma}$, $I_{220\gamma}$, and $I_{311\gamma}$ respectively represent the intensities of the diffraction peaks of (200), (220), and (311) of the fcc phase, and $I_{200b}$ and $I_{211b}$ respectively represent the intensities of the diffraction peaks of (200) and (211) of the bcc phase.

(Si Concentration Ratio C1/C2 Is 1.25 or Less) The ratio C1/C2 of the upper limit C1 (mass %) to the lower limit C2 (mass %) of the Si concentration in a cross section in the thickness direction of the high-strength steel sheet is set to 1.25 or less. The ratio C1/C2 is more preferably 1.15 or less. In a case where C1/C2 is 1.25 or less, the segregation of Si can be controlled, the structure becomes uniform, and the precipitates such as iron carbides shown below can be uniformly precipitated, thereby enhancing uniform bake hardenability.

The degree of Si segregation represented by C1/C2 is measured as follows. The steel sheet is adjusted so that a surface having the rolling direction thereof as a normal direction (that is, a cross section in the thickness direction of the steel sheet) can be observed, the surface is subjected to mirror polishing, and in a range of 100 μm×100 μm in the center portion of the steel sheet in the cross section in the thickness direction of the steel sheet, Si concentrations are measured at 200 points at intervals of 0.5 μm from one surface side toward the other surface side along the thickness direction of the steel sheet by an electron probe microanalyzer (EPMA) device. The same measurement is performed on another four lines so as to cover almost the entire region within the same 100 μm×100 μm range, the highest value among Si concentrations at a total of 1000 points measured on all the five lines is set to the upper limit C1 (mass %) of the Si concentrations, the lowest value is set to the lower limit C2 (mass %) of the Si concentrations, and the ratio C1/C2 is calculated.

(Number Density of Precipitates Having Major Axis of 0.05 μm or More and 1.00 μm or Less and Aspect Ratio of 1:3 or More Is 30/μm$^2$ or More)

The present embodiment is significantly characterized by having precipitates having a major axis of 0.05 μm or more and 1.00 μm or less and an aspect ratio of 1:3 or more in a number density of 30/μm$^2$ or more. In the present invention, the aspect ratio refers to the ratio of the longest diameter (major axis) of a precipitate to the longest diameter (minor axis) among the diameters of the precipitate orthogonal to the major axis. The precipitate is not particularly limited as long as the precipitate satisfies the requirements for the major axis and the aspect ratio described above, and examples thereof include carbides. In particular, in a case where the high-strength steel sheet according to the present invention is manufactured according to a preferred manufacturing method including a heat treatment step described later, the precipitate contains iron carbide or consists of iron carbide. According to the present invention, by including a relatively large amount of such precipitates in the structure, for example, the formation of dislocation cells caused by the entanglement of dislocations can be suppressed, the amount of locked dislocations caused by carbon or the like that diffuses during bake hardening can be increased, and as a result, it becomes possible to significantly increase the bake hardening amount. Such knowledge has not been hitherto known, and is first discovered by the present inventors, which is surprising and remarkable. The size of the dislocation cells generated in martensite is about several tens nm or more and several hundreds nm or less. Therefore, in order to suppress the formation of dislocation cells, the same size of precipitate is required. When the major axis is less than 0.05 μm, the formation of dislocation cells cannot be suppressed. Therefore, the major axis of the precipitate is set to 0.05 μm or more. The major axis is more preferably 0.10 μm or more. On the other hand, when the major axis is larger than 1.00 the precipitates become coarse and the amount of solid solution carbon is greatly reduced, and the bake hardening amount is reduced. Therefore, the major axis of the precipitate is set to 1.00 μm or less. The major axis of the precipitate is more preferably 0.80 μm or less.

The shape of the precipitate is preferably a needle shape rather than a spherical shape, and the aspect ratio is preferably 1:3 or more. When the aspect ratio is less than 1:3, the shape of the precipitate is regarded as being spherical and the generation of dislocation cells cannot be suppressed. Therefore, the aspect ratio is set to 1:3 or more. The aspect ratio is more preferably 1:5 or more.

The precipitation point of the precipitate is preferably within the lath. This is because the point where the dislocation cell is most easily formed is within the lath, and dislocation cells are hardly seen between the laths. Here, the lath refers to a structure generated in the prior austenite grain boundary by martensitic transformation. In order to facilitate understanding, FIG. 1 shows an image diagram showing the precipitation state of the precipitates in the high-strength steel sheet according to the present invention. Referring to FIG. 1, it can be seen that in a lath structure 3 ((b) in FIG. 1) formed in a prior austenite grain boundary 2 during microsegregation of Si having a uniform structure 1 ((a) in FIG. 1), the needle-like precipitates 5 are uniformly precipitated on the entire surface within the lath 4 instead of between the laths 4 ((c) in FIG. 1).

The number density of precipitates is 30/μm$^2$ or more. In a case where the number density of precipitates is less than 30/μm$^2$, when dislocations are introduced and moved by prestrain, the dislocations interact with other dislocations before encountering the precipitates, and dislocation cells are formed. Therefore, the number density of precipitates is set to 30/μm$^2$ or more. The number density is more preferably 40/μm$^2$ or more.

In the present invention, the morphology and number density of the precipitates are determined by observation with an electron microscope, and are measured by, for example, transmission electron microscope (TEM) observation. Specifically, a thin film sample is cut out from a region between a ⅜ position and a ¼ position of the thickness of the steel sheet from the surface of the steel sheet, and is observed in a bright visual field. The sample is cut by 1 μm$^2$ at an appropriate magnification of 10,000-fold to 100,000-fold, and precipitates having a major axis of 0.05 μm or more and 1 μm or less and an aspect ratio of 1:3 or more are counted and obtained. This operation is performed in five or more consecutive visual fields, and the average is taken as the number density.

Next, the mechanical properties of the present invention will be described.

(Tensile Strength: 1300 MPa or More)

According to the high-strength steel sheet of the present invention having the above composition and structure, it is possible to achieve high tensile strength, specifically, a tensile strength of 1300 MPa or more. Here, the tensile strength is set to 1300 MPa or more in order to meet the demand for a reduction in the weight of a vehicle body. The tensile strength is preferably 1400 MPa or more, and more preferably 1500 MPa or more.

According to the high-strength steel sheet of the present invention, it is possible to achieve excellent bake hardening amount. More specifically, according to the high-strength steel sheet of the present invention, it is possible to achieve a bake hardening amount BH such that a value obtained by subtracting the stress at the time of application of 2% prestrain from the stress when a test piece subjected to a heat treatment at 170° C. for 20 minutes is re-tensioned after the application of 2% prestrain is 180 MPa or more, and preferably 200 MPa or more. When the value of BH is less than 180 MPa, it is difficult to perform forming and the strength after forming is low, so that it cannot be said excellent bake hardenability is achieved.

Similarly, according to the high-strength steel sheet of the present invention, it is possible to achieve excellent uniform bake hardenability. The uniform bake hardenability can be evaluated, for example, from the viewpoint of whether or not the difference in bake hardening amount in a case where different prestrains are applied can be controlled to a predetermined value or less. In the present invention, unless otherwise specified, the bake hardening amount difference ABH means the absolute value of the difference between the BH in a case where the prestrain is 2% and the BH in a case where the prestrain is 1%. According to the present invention, the bake hardening amount difference ABH can be controlled to 20 MPa or less, and preferably 10 MPa or less, so that even if there is a difference in the strain amount applied during press forming, bake hardening can be uniformly exhibited, that is, it is possible to provide a high-strength steel sheet having a small prestrain dependence of the bake hardening amount (high uniform bake hardenability). On the other hand, in a case where the above-mentioned ABH is larger than 20 MPa, the prestrain dependence of the bake hardening amount is large and it cannot be said that the excellent uniform bake hardenability is achieved.

<Manufacturing Method of High-Strength Steel Sheet>

Next, a preferred manufacturing method of a high-strength steel sheet according to the present embodiment will be described.

The following description is intended to exemplify the characteristic method for manufacturing the high-strength steel sheet of the present invention, and is not intended to limit the high-strength steel sheet of the present invention to be manufactured by the manufacturing method described below.

The preferred manufacturing method of a high-strength steel sheet of the present invention is characterized by including:

a step of forming a slab by casting a molten steel having the chemical composition described above;

a rough rolling step of performing rough rolling on the slab in a temperature range of 1050° C. or higher and 1250° C. or lower, in which the rough rolling includes reverse rolling performed an even number of times, which is two passes or more and 16 passes or less, the reverse rolling having a rolling reduction of 30% or less per pass, the difference in the rolling reduction between two passes during one reciprocation is 20% or less, the rolling reduction of an even-numbered pass during one reciprocation is higher by 5% or more than the rolling reduction of an odd-numbered pass, and holding is performed for five seconds or longer after the rough rolling;

a finish rolling step of performing finish rolling on the rough-rolled steel sheet in a temperature range of 850° C. or higher and 1050° C. or lower, in which the finish rolling is performed by four or more continuous rolling stands, the rolling reduction of the first stand is 15% or more, and the finish-rolled steel sheet is wound in a temperature range of 400° C. or lower;

a cold rolling step of performing cold rolling on the obtained hot-rolled steel sheet at a rolling reduction of 15% or more and 45% or less;

an annealing step of heating the obtained cold-rolled steel sheet at an average heating rate of 10° C./s or faster, holding the obtained steel sheet in a temperature range of $Ac_3$ or higher and 1000° C. or lower for 10 to 1000 seconds, and then cooling the obtained steel sheet to 70° C. or lower at an average cooling rate of 10° C./s or faster; and a heat treatment step of holding the obtained steel sheet in a temperature range of 200° C. or higher and 350° C. or lower for 100 seconds or longer, and then cooling the obtained steel sheet to 100° C. or lower at an average cooling rate of 2° C./s or faster. Hereinafter, each step will be described.

(Step of Forming Slab)

First, a molten steel having the chemical composition of the high-strength steel sheet according to the present invention described above is cast to form a slab to be provided for rough rolling. The casting method may be an ordinary casting method, and a continuous casting method, an ingot-making method, or the like can be adopted. In terms of productivity, the continuous casting method is preferable.

(Rough Rolling Step)

Before the rough rolling, it is preferable to heat the slab to a solutionizing temperature range of 1000° C. or higher and 1300° C. or lower. A heating retention time is not particularly specified, but it is preferable to hold the heating temperature for 30 minutes or longer in order to cause the central part of the slab to achieve a predetermined temperature. The heating retention time is preferably 10 hours or shorter and more preferably five hours or shorter in order to suppress excessive scale loss. When the temperature of the slab after casting is 1050° C. or higher and 1250° C. or lower, the slab may be subjected to rough rolling as it is without being heated and held in the temperature range, and may be subjected to hot direct rolling or direct rolled.

Next, by performing reverse rolling on the slab as the rough rolling, a Si segregation portion in the slab formed during solidification in the step of forming a slab can have a uniform structure without being formed into a plate-like segregation portion elongated in one direction. The formation of a Si concentration distribution having such a uniform structure will be described in more detail. First, in a slab before starting rough rolling, a plurality of portions where the alloying elements such as Si are concentrated are arranged substantially perpendicularly in a comb-like form from both surfaces toward the inside of the slab.

On the other hand, in the rough rolling, the surface of the slab is elongated in a direction in which rolling proceeds in each rolling pass. The direction in which rolling proceeds is a direction in which the slab travels with respect to rolling rolls. As the surface of the slab is thus elongated in the direction in which rolling proceeds, the Si segregation portion growing toward the inside from the surface of the slab is inclined in the direction in which the slab travels in each rolling pass.

Here, in the case of so-called unidirectional rolling in which the direction in which the slab travels in each pass of the rough rolling is always the same direction, the inclination of the Si segregation portion gradually increases in the same direction in each pass while the Si segregation portion maintains a substantially straight state. Then, at the finish of the rough rolling, the Si segregation portion is in a posture substantially parallel to the surface of the slab while maintaining a substantially straight state, and flat microsegregation is formed.

On the other hand, in the case of reverse rolling in which the directions in which the slab travels in the respective passes of the rough rolling alternately become opposite directions, the Si segregation portion inclined in the immediately preceding pass is inclined in the reverse direction in the subsequent pass, and as a result, the Si segregation portion has a bent shape. Therefore, in the reverse rolling, passes alternately performed in opposite directions are repeatedly performed, whereby the Si segregation portion has a zigzag shape that is alternately bent.

When a plurality of zigzag shapes that are alternately bent are arranged in this manner, plate-like microsegregation disappears, and a Si concentration distribution that is uniformly intricate is formed. By adopting such a structure, Si is more likely to diffuse due to a heat treatment in a subsequent step, and a hot-rolled steel sheet having a more uniform Si concentration can be obtained. In addition, since a uniformly intricate Si concentration distribution is formed over the entire steel sheet by the above-mentioned reverse rolling, such a uniform structure is similarly formed not only in a plate thickness cross section parallel to the rolling direction but also in a plate thickness cross section with the rolling direction as the normal line.

When the rough rolling temperature range is lower than 1050° C., it becomes difficult to complete the rolling at 850° C. or higher in the final pass of the rough rolling, resulting in defective shape. Therefore, the rough rolling temperature range is preferably 1050° C. or higher. The rough rolling temperature range is more preferably 1100° C. or higher. When the rough rolling temperature range exceeds 1250° C., scale loss increases and there is concern that slab cracking may occur. Therefore, the rough rolling temperature range is preferably 1250° C. or lower.

When the rolling reduction per pass in the rough rolling exceeds 30%, the shear stress during the rolling increases, and the Si segregation portion becomes non-uniform, so that a uniform structure cannot be obtained. Therefore, the rolling reduction per pass in the rough rolling is set to 30% or less. The smaller the rolling reduction, the smaller the shear strain at the time of rolling, and the uniform structure can be obtained. Therefore, the lower limit of the rolling reduction is not particularly specified, but is preferably 10% or more from the viewpoint of productivity.

In order to make the Si concentration distribution to have a uniform structure, reverse rolling is preferably performed in two or more passes, and more preferably four or more passes. However, when reverse rolling is performed in more than 16 passes, it becomes difficult to secure a sufficient finish rolling temperature. Therefore, reverse rolling is performed in 16 or less passes. Furthermore, it is desirable that passes of which the travelling directions are opposite to each other are performed the same number of times, that is, the total number of passes is an even number. However, in a general rough rolling line, the inlet side and the outlet side of the rough rolling are located on opposite sides with rolls therebetween. Therefore, the number of passes (rolling) in the direction from the inlet side to the outlet side of the rough rolling is larger by one. Then, in the last pass (rolling), the Si segregation portion has a flat shape and is less likely to form a uniform structure. In a case where rough rolling is performed on such a hot rolling line, it is preferable that rolling is omitted by opening the rolls in the last pass.

In the reverse rolling, when there is a difference in the rolling reduction between two passes included in rolling of one reciprocation, a defective shape is likely to occur, and the Si segregation portion becomes non-uniform, so that a uniform structure cannot be obtained. Therefore, during the rough rolling, the difference in the rolling reduction between two passes included in one reciprocation of the reverse rolling is set to 20% or less. The difference is preferably 10% or less.

As will be described later, although tandem multi-stage rolling in the finish rolling is effective for refining a recrystallization structure, tandem rolling facilitates the formation of flat microsegregation. In order to utilize the tandem multi-stage rolling, it is necessary that the rolling reduction in even-numbered passes in the reverse rolling is larger than the rolling reduction in odd-numbered passes to control microsegregation formed in the subsequent tandem rolling. The effect becomes significant when the rolling reduction in the even-numbered pass (return path) is higher than the rolling reduction of the odd-numbered pass (forward path) by 5% or more in one reciprocation of the reverse rolling. Therefore, in one reciprocation of the reverse rolling, it is preferable that the rolling reduction of the even-numbered pass is higher than the rolling reduction of the odd-numbered pass by 5% or more.

In order to make the intricate structure of Si generated by the reverse rolling in the rough rolling to be uniform by austenite grain boundary migration, it is preferable that holding is performed between the rough rolling and the finish rolling for five seconds or longer.

(Finish Rolling Step)

After the reverse rolling in the rough rolling, in order to narrow the spacing of Si segregation zones caused by secondary dendrite arms by increasing the rolling reduction of the tandem rolling in the finish rolling, the finish rolling is preferably performed by four or more continuous rolling stands. When the finish rolling temperature is lower than 850° C., recrystallization does not sufficiently occur, a structure elongated in the rolling direction is formed, and a plate-like structure due to the elongated structure is generated in a subsequent step. Therefore, the finish rolling temperature is preferably 850° C. or higher. The finish rolling temperature is preferably 900° C. or higher. On the other hand, when the finish rolling temperature exceeds 1050° C., it becomes difficult to generate fine austenite recrystallized grains, Si segregation at grain boundaries becomes difficult, and the Si segregation zones are likely to be flat. Therefore, the finish rolling temperature is preferably 1050° C. or lower. As necessary, the steel sheet subjected to the rough rolling may be heated after the rough rolling step and before the finish rolling step at an appropriate temperature. Furthermore, when the rolling reduction of the first stand of the finish rolling is set to 15% or more, a large amount of recrystallized grains are generated, and Si is likely to be uniformly dispersed by the subsequent grain boundary migration. As described above, by limiting not only the rough rolling step but also the finish rolling step, it is possible to suppress the flat Si microsegregation. The "finish rolling temperature" indicates the surface temperature of the steel sheet from the start of finish rolling to the finish of finish rolling.

When a coiling temperature exceeds 400° C., the surface properties are deteriorated due to internal oxidation. Therefore, the coiling temperature is preferably 400° C. or lower. When the steel sheet structure is a homogeneous structure of martensite or bainite, the homogeneous structure is likely to be formed by annealing. Therefore, the coiling temperature is more preferably 300° C. or lower.

(Cold Rolling Step)

The hot-rolled steel sheet obtained in the finish rolling step is pickled and then cold-rolled to obtain a cold-rolled steel sheet. In order to maintain laths of martensite, the rolling reduction is preferably 15% or more and 45% or less. When the rolling reduction exceeds 45%, the uniform structure of Si segregation is disturbed, so that in the lath structure of martensite, the amount of carbides precipitated between the laths increases and the amount of needle-like precipitates precipitated within the laths decreases. As a result, the precipitation of carbides having an aspect ratio of 1:3 or more is impeded, which is not preferable. The pickling may be ordinary pickling.

(Annealing Step)

The steel sheet obtained through the cold rolling step is subjected to an annealing treatment. For heating at an annealing temperature, the temperature is raised at an average heating rate of 10° C./s or faster, and the heating is held in a temperature range of $Ac_3$ or higher and 1000° C. or lower for 10 to 1000 seconds. This temperature range and annealing time are set for austenitic transformation of the entire surface of the steel sheet. When the holding temperature exceeds 1000° C. or the annealing time exceeds 1000 seconds, the austenite grain size becomes coarse and martensite with a large lath width is formed, resulting in a decrease in toughness. Therefore, the annealing temperature is set to $Ac_3$ or higher and 1000° C. or lower, and the annealing time is set to 10 to 1000 seconds.

The $Ac_3$ point is calculated by the following formula. Into an element symbol in the following formula, the mass % of the corresponding element is substituted. 0 mass % is substituted into the elements not contained.

$$Ac_3=881-335\times C+22\times Si-24\times Mn-17\times Ni-1\times Cr-27\times Cu+41\times Mo$$

After holding the annealing temperature, cooling is performed at an average cooling rate of 10° C./s or faster. In order to freeze the structure and cause the martensitic transformation to efficiently occur, the cooling rate may be fast. However, at a cooling rate of slower than 10° C./s, martensite is not sufficiently generated, and the structure cannot be controlled into a desired structure. Therefore, the cooling rate is set to 10° C./s or faster. A plating step may be added during the cooling after the annealing and holding as long as the cooling rate can be held.

A cooling stop temperature is set to 70° C. or lower. This is because as-quenched martensite is generated on the entire surface by cooling. When cooling is stopped at higher than 70° C., there is a possibility that a structure other than martensite may be generated. In addition, in a case where martensite is generated, precipitates such as iron carbide that are spheroidized due to self-tempering are generated. As a result, needle-like precipitates such as iron carbide are not precipitated in a subsequent step, desired precipitates are not obtained, and the bake hardenability is deteriorated. Therefore, the cooling stop temperature is set to 70° C. or lower, and preferably 60° C. or lower.

(Heat Treatment Step)

The high-strength steel sheet according to the present embodiment has a great feature in the precipitation morphology of precipitates such as iron carbide. Such precipitates are precipitated by forming martensite in the slab containing an appropriate amount of Si and then holding the slab in a temperature range of 200° C. or higher and 350° C. or lower by heating. In a case where the holding temperature is lower than 200° C., the major axis of the precipitates may be less than 0.05 μm, and dislocation cells cannot be suppressed. Therefore, the holding temperature is set to 250° C. or higher. In a case where the holding temperature is higher than 350° C., the precipitates may become coarse, the number density thereof may be small, and the major axis thereof may become more than 1.00 μm. Accordingly, dislocation cells cannot be suppressed. Therefore, the holding temperature is set to 350° C. or lower. The retention time is set to 100 seconds or longer. When the retention time is shorter than 100 seconds, iron carbide cannot be stably precipitated. Therefore, the retention time is set to 100 seconds or longer. Thereafter, from the viewpoint of productivity, cooling to 100° C. or lower is performed at an average cooling rate of 2° C./s or faster.

(Skin Pass Rolling Step)

After the heat treatment step, skin pass rolling (temper rolling) may be optionally performed. In the high-strength steel sheet according to the embodiment of the present invention, since dislocation cells are suppressed by the precipitates, dislocation cells are not formed and bake hardenability is not deteriorated even if skin pass rolling is performed. However, the rolling reduction is preferably set to 2.0% or less because controlling the plate thickness is difficult. The rolling reduction is more preferably set to 1.0% or less.

In this manner, the high-strength steel sheet according to the embodiment of the present invention can be manufactured.

It should be noted that each of the above-described embodiments is merely an example of an embodiment for carrying out the present invention, and the technical scope of the present invention should not be construed as being limited by these embodiments. That is, the present invention can be implemented in various forms without departing from the technical idea or the main features thereof.

Example 1

Next, examples of the present invention will be described. The conditions in the examples are one example of conditions adopted to confirm the feasibility and effects of the present invention, and the present invention is not limited to this one example of conditions. The present invention can adopt various conditions as long as the object of the present invention is achieved without departing from the gist of the present invention.

A slab having the chemical composition shown in Table 1 was manufactured, and the slab was heated to 1300° C. for one hour, and then subjected to rough rolling and finish rolling under the conditions shown in Table 2 to obtain a hot-rolled steel sheet. Thereafter, the hot-rolled steel sheet was pickled and cold-rolled at the rolling reduction shown in Table 2 to obtain a cold-rolled steel sheet. Subsequently, annealing and a heat treatment were performed under the conditions shown in Table 2. In addition, each temperature shown in Table 2 is a surface temperature of the steel sheet. Furthermore, in Table 2, "difference in rolling reduction between passes in one reciprocation" means the same difference in rolling reduction in all the reciprocation passes.

In Table 2, $Ac_3$ was calculated by the following formula. Into an element symbol in the following formula, the mass % of the corresponding element was substituted. 0 mass % is substituted into the elements not contained.

$$Ac_3=881-335\times C+22\times Si-24\times Mn-17\times Ni-1\times Cr-27\times Cu+41\times Mo$$

TABLE 1

| Kind of | Chemical composition (mass %) | | | | | | | | | | | | | | | | | | |
|---|---|---|---|---|---|---|---|---|---|---|---|---|---|---|---|---|---|---|---|
| steel | C | Si | Mn | P | S | Al | N | Ti | Nb | V | Cu | Ni | Mo | Cr | W | Ca | Mg | REM | B |
| A | 0.30 | 1.500 | 2.50 | 0.012 | 0.004 | 0.020 | 0.003 | | | | | | | | | | | | |
| B | 0.35 | 2.000 | 2.80 | 0.010 | 0.003 | 0.020 | 0.003 | 0.030 | | | | | | | | | | | |
| C | 0.15 | 0.900 | 2.70 | 0.013 | 0.004 | 0.020 | 0.003 | | | | | 0.010 | | | | | | | |
| D | 0.20 | 0.800 | 3.00 | 0.011 | 0.004 | 0.020 | 0.003 | | | | | | 0.005 | | | | | | |
| E | 0.20 | 1.200 | 3.00 | 0.012 | 0.004 | 0.020 | 0.003 | | | | 0.010 | | | | | | | | |
| F | 0.25 | 1.200 | 3.30 | 0.013 | 0.003 | 0.020 | 0.003 | | | 0.004 | | | | | | | | | |
| G | **0.09** | 1.000 | 3.10 | 0.010 | 0.004 | 0.020 | 0.003 | | | | | | | | | | | | |
| H | 0.15 | **0.003** | 2.80 | 0.010 | 0.004 | 0.020 | 0.003 | | | | | | | | | | | | |
| I | 0.27 | 0.600 | 3.20 | 0.009 | 0.004 | 0.020 | 0.003 | 0.005 | 0.005 | | | | | | | | | | |
| J | 0.32 | 1.800 | 2.90 | 0.012 | 0.004 | 0.020 | 0.003 | | | | | | | | | 0.003 | | | |
| K | 0.38 | 1.800 | **0.05** | 0.010 | 0.003 | 0.020 | 0.003 | | | | | | | | | | | | |
| L | 0.17 | 0.900 | 4.00 | 0.012 | 0.004 | 0.020 | 0.003 | | | | | | | 0.005 | | | | | |
| M | **0.60** | 1.100 | 3.00 | 0.011 | 0.004 | 0.020 | 0.003 | | | | | | | | | | | | |
| N | 0.21 | 2.500 | 3.30 | 0.009 | 0.003 | 0.020 | 0.003 | | | | | | | | 0.005 | | | | |
| O | 0.23 | 1.000 | 3.10 | 0.010 | 0.004 | 0.020 | 0.003 | | | | | | | | | | | | |
| P | 0.30 | 1.000 | 2.80 | 0.013 | 0.004 | 0.020 | 0.003 | | | | | | | | | | 0.004 | 0.009 | |

TABLE 1-continued

| Kind of steel | Chemical composition (mass %) | | | | | | | | | | | | | | | | | | |
|---|---|---|---|---|---|---|---|---|---|---|---|---|---|---|---|---|---|---|---|
| | C | Si | Mn | P | S | Al | N | Ti | Nb | V | Cu | Ni | Mo | Cr | W | Ca | Mg | REM | B |
| Q | 0.18 | 1.000 | 3.20 | 0.011 | 0.004 | 0.020 | 0.003 | | | | | | | | | | | | 0.0019 |
| R | 0.26 | 0.800 | 3.00 | 0.010 | 0.004 | 0.020 | 0.003 | | | | | | | | | | | | |

Bold underline indicates outside of the range of the invention.
Blank space in the table indicates that the corresponding chemical element is not intentionally added.

TABLE 2-1

| | | Rough rolling | | | | | | Finish rolling | | | | |
|---|---|---|---|---|---|---|---|---|---|---|---|---|
| No. | Kind of steel | Number of passes of rough rolling | Maximum rolling reduction of rough rolling (%) | Rough rolling start temperature (° C.) | Difference in Hilling reduction between passes in one reciprocation (return path − forward path) (%) | Rough rolling completion temperature (° C.) | Time until finish rolling after rough rolling (s) | Hot rolling stands (number) | Finish rolling start temperature (° C.) | Rolling reduction of first stand (%) | Finish rolling finishing temperature (° C.) | Coiling temperature (° C.) |
| 1 | A | 8 | 25 | 1200 | 10 | 1100 | 7 | 4 | 1050 | 20 | 900 | 240 |
| 2 | A | 8 | 30 | 1200 | 10 | 1100 | 7 | 4 | 1000 | 20 | 900 | 230 |
| 3 | B | 8 | 30 | 1200 | 10 | 1100 | 7 | 4 | 1000 | 20 | 900 | 250 |
| 4 | C | 8 | 30 | 1200 | 10 | 1100 | 7 | 4 | 1000 | 20 | 900 | 270 |
| 5 | D | 8 | 30 | 1200 | 10 | 1100 | 7 | 4 | 1000 | 20 | 900 | 230 |
| 6 | D | 8 | 30 | 1200 | 10 | 1100 | 7 | 4 | 1000 | 20 | 900 | 230 |
| 7 | E | 8 | 25 | 1200 | 10 | 1050 | 7 | 4 | 1000 | 20 | 850 | 250 |
| 8 | E | 8 | 25 | 1200 | 10 | 1100 | 7 | 4 | 1050 | 20 | 900 | 300 |
| 9 | E | 8 | 30 | 1200 | 10 | 1100 | 7 | 4 | 1050 | 20 | 900 | 200 |
| 10 | F | 8 | 30 | 1200 | 10 | 1100 | 7 | 4 | 1000 | 20 | 900 | 200 |
| 11 | F | 8 | 30 | 1200 | 10 | 1100 | 7 | 4 | 1000 | 20 | 900 | 200 |
| 12 | F | 8 | 25 | 1200 | 10 | 1100 | 7 | 4 | 1000 | 20 | 900 | 250 |
| 13 | G | 8 | 30 | 1200 | 10 | 1100 | 7 | 4 | 1050 | 20 | 900 | 250 |
| 14 | H | 8 | 30 | 1200 | 10 | 1100 | 7 | 4 | 1000 | 20 | 850 | 200 |
| 15 | I | 8 | 25 | 1200 | 10 | 1100 | 7 | 4 | 1000 | 20 | 900 | 230 |
| 16 | I | 8 | 30 | 1200 | **25** | 1100 | 7 | 4 | 1000 | 20 | 900 | 230 |
| 17 | I | 8 | 25 | 1200 | **−10** | 1100 | 7 | 4 | 1000 | 20 | 900 | 230 |
| 18 | J | 8 | 30 | 1200 | 10 | 1100 | 7 | 4 | 1000 | 20 | 900 | 250 |
| 19 | K | 8 | 30 | 1200 | 10 | 1100 | 7 | 4 | 1000 | 20 | 900 | 180 |
| 20 | L | 8 | 30 | 1200 | 10 | 1100 | 7 | 4 | 1000 | 20 | 900 | 200 |
| 21 | L | 8 | **45** | 1200 | 10 | 1100 | 7 | 4 | 1000 | 20 | 900 | 200 |
| 22 | M | 8 | 30 | 1200 | 10 | 1100 | 7 | 4 | 1000 | 20 | 900 | 180 |
| 23 | N | 8 | 30 | 1200 | 10 | 1100 | 7 | 4 | 1000 | 20 | 850 | 190 |
| 24 | N | 8 | 30 | 1200 | 10 | 1100 | **2** | 4 | 1000 | 20 | 850 | 190 |
| 25 | O | 8 | 30 | 1200 | 10 | 1100 | 7 | 4 | 1000 | 20 | 900 | 210 |
| 26 | O | 8 | 30 | 1200 | 10 | 1100 | 7 | **2** | 1000 | 20 | 900 | 210 |
| 27 | O | 8 | 30 | 1200 | 10 | 1100 | 7 | 4 | 1000 | **10** | 900 | 210 |
| 28 | P | 8 | 30 | 1200 | 10 | 1100 | 7 | 4 | 1000 | 20 | 900 | 200 |
| 29 | P | 8 | 30 | 1200 | 10 | 1100 | 7 | 4 | **1150** | 20 | 900 | 200 |
| 30 | P | 8 | 30 | 1200 | 10 | 1100 | 7 | 4 | 1000 | 20 | 900 | 200 |
| 31 | Q | 8 | 25 | 1200 | 10 | 1100 | 7 | 4 | 1050 | 20 | 900 | 210 |
| 32 | R | **13** | 30 | 1200 | 10 | 1100 | 7 | 4 | 1000 | 20 | 900 | 220 |
| 33 | R | 8 | 30 | 1200 | 10 | 1100 | 7 | 4 | 1000 | 20 | 900 | 240 |
| 34 | R | 8 | 30 | 1200 | 10 | 1100 | 7 | 4 | 1050 | 20 | 900 | 270 |

Bold underline indicates outside of the desirable range.

TABLE 2-2

| | Cold | Annealing | | | | | | Heat treatment | | | | Skin pass |
|---|---|---|---|---|---|---|---|---|---|---|---|---|
| No. | rolling Rolling reduction (%) | Ac3 (° C.) | Average heating rate (° C./s) | Annealing temperature (° C.) | Annealing time (s) | Average cooling rate (° C./s) | Cooling stop temperature (° C.) | Holding temperature (° C.) | Retention time (s) | Average cooling rate (° C./s) | Cooling stop temperature (° C.) | rolling Rolling reduction (%) |
| 1 | 20 | 761 | 20 | 900 | 300 | 50 | 45 | 250 | 600 | 5 | 50 | Absent |
| 2 | 20 | 761 | 20 | 850 | 200 | 50 | 40 | 300 | **5** | 5 | 45 | Absent |
| 3 | 30 | 741 | 20 | 850 | 200 | 10 | 50 | 250 | 600 | 5 | 45 | 0.2 |
| 4 | 30 | 786 | 20 | 900 | 200 | 50 | 45 | 350 | 600 | 5 | 45 | Absent |
| 5 | 30 | 760 | 20 | 900 | 200 | 10 | 45 | 250 | 600 | 5 | 50 | Absent |
| 6 | 30 | 760 | 20 | 900 | 200 | 10 | 45 | **100** | 600 | 5 | 50 | Absent |

TABLE 2-2-continued

| No. | Cold rolling Rolling reduction (%) | Annealing Ac3 (° C.) | Annealing Average heating rate (° C./s) | Annealing Annealing temperature (° C.) | Annealing Annealing time (s) | Annealing Average cooling rate (° C./s) | Annealing Cooling stop temperature (° C.) | Heat treatment Holding temperature (° C.) | Heat treatment Retention time (s) | Heat treatment Average cooling rate (° C./s) | Heat treatment Cooling stop temperature (° C.) | Skin pass rolling Rolling reduction (%) |
|---|---|---|---|---|---|---|---|---|---|---|---|---|
| 7 | 40 | 768 | 20 | 900 | 200 | 50 | 45 | 300 | 600 | 5 | 50 | 0.2 |
| 8 | 30 | 768 | 20 | **650** | 200 | 50 | 50 | 350 | 600 | 5 | 45 | 0.2 |
| 9 | 40 | 768 | 20 | 850 | **2** | 50 | 50 | 250 | 600 | 5 | 40 | 0.2 |
| 10 | 40 | 744 | 20 | 900 | 200 | 50 | 45 | 300 | 600 | 5 | 40 | Absent |
| 11 | 30 | 744 | 20 | 900 | 200 | **1** | 40 | 250 | 600 | 5 | 50 | Absent |
| 12 | 40 | 744 | 20 | 900 | 200 | 50 | 40 | **550** | 600 | 5 | 45 | Absent |
| 13 | 20 | 798 | 20 | 900 | 200 | 50 | 50 | 250 | 600 | 5 | 50 | Absent |
| 14 | 20 | 764 | 20 | 900 | 200 | 50 | 45 | 300 | 600 | 5 | 45 | Absent |
| 15 | 40 | 727 | 20 | 900 | 200 | 50 | 50 | 250 | 600 | 5 | 50 | Absent |
| 16 | 40 | 727 | 20 | 900 | 200 | 50 | 45 | 300 | 600 | 5 | 45 | 0.2 |
| 17 | 40 | 727 | 20 | 900 | 200 | 50 | 45 | 300 | 600 | 5 | 45 | 0.2 |
| 18 | 40 | 744 | 20 | 900 | 200 | 50 | 50 | 300 | 600 | 5 | 40 | Absent |
| 19 | 30 | 792 | 20 | 880 | 200 | 50 | 45 | 300 | 600 | 5 | 45 | 0.2 |
| 20 | 40 | 748 | 20 | 900 | 300 | 50 | 40 | 250 | 600 | 5 | 45 | Absent |
| 21 | 40 | 748 | 20 | 900 | 300 | 50 | 45 | 300 | 600 | 5 | 40 | Absent |
| 22 | 30 | 632 | 20 | 900 | 300 | 50 | 45 | 300 | 600 | 5 | 40 | 0.2 |
| 23 | 30 | 786 | 20 | 850 | 200 | 50 | 45 | 250 | 600 | 5 | 40 | 0.2 |
| 24 | 40 | 786 | 20 | 850 | 200 | 50 | 45 | 250 | 600 | 5 | 40 | 0.2 |
| 25 | 30 | 752 | 20 | 900 | 200 | 200 | 40 | 300 | 600 | 5 | 50 | 0.2 |
| 26 | 20 | 752 | 20 | 900 | 200 | 200 | 40 | 300 | 600 | 5 | 50 | 0.2 |
| 27 | 40 | 752 | 20 | 900 | 200 | 200 | 40 | 300 | 600 | 5 | 50 | 0.2 |
| 28 | 40 | 735 | 20 | 780 | 200 | 50 | 50 | 300 | 600 | 5 | 45 | 0.2 |
| 29 | 40 | 735 | 20 | 780 | 200 | 50 | 50 | 300 | 600 | 5 | 45 | 0.2 |
| 30 | **65** | 735 | 20 | 780 | 200 | 50 | 50 | 300 | 600 | 5 | 45 | 0.2 |
| 31 | 40 | 766 | 20 | 900 | 200 | 50 | 55 | 250 | 600 | 5 | 45 | 0.2 |
| 32 | 30 | 740 | 20 | 900 | 200 | 50 | 45 | 300 | 600 | 5 | 40 | Absent |
| 33 | 40 | 740 | 20 | 850 | 200 | 50 | **350** | 300 | 600 | 5 | 40 | Absent |
| 34 | 40 | 740 | 20 | 850 | 200 | 50 | 45 | 300 | 600 | 5 | 40 | Absent |

Bold underline indicates outside of the desirable range.

The area ratios of martensite and residual austenite were obtained for the obtained cold-rolled steel sheet using SEM-EBSD and an X-ray diffraction method.

In particular, the area ratio of martensite was determined as follows. First, a sample was taken with a plate thickness cross section perpendicular to the rolling direction of the steel sheet as an observed section, the observed section was polished, the structure thereof at a thickness ¼ position of the steel sheet was observed with SEM-EBSD at a magnification of 5,000-fold, the resultant was subjected to image analysis in a visual field of 100 μm×100 μm to measure the area ratio of martensite, and the average of values measured at any five visual fields was determined as the area ratio of martensite.

In addition, the steel structure of the obtained cold-rolled steel sheet was observed by TEM to obtain the presence or absence of precipitates, and the major axis, aspect ratio, and number density thereof. Specifically, a thin film sample was cut out from a region between a ⅜ position and a ¼ position of the thickness of the steel sheet from the surface of the steel sheet, and was observed in a bright visual field. The sample was cut by 1 $\mu m^2$ at an appropriate magnification between 10,000-fold and 100,000-fold, and precipitates having a major axis of 0.05 μm or more and 1 μm or less and an aspect ratio of 1:3 or more were counted and obtained. This operation was performed in five consecutive visual fields, and the average was taken as the number density. The results are shown in Table 3.

Furthermore, the tensile strength TS, fracture elongation EL, bake hardening amount BH, and bake hardening amount difference ABH of the obtained cold-rolled steel sheet were measured. In the measurement of the tensile strength TS, fracture elongation EL, bake hardening amount BH, and bake hardening amount difference ABH, JIS No. 5 tensile test pieces whose longitudinal direction was perpendicular to the rolling direction were taken, and a tensile test was conducted according to JIS Z 2241. The bake hardening amount BH is a value obtained by subtracting the stress at the time of application of 2% prestrain from the stress when a test piece subjected to a heat treatment at 170° C. for 20 minutes is re-tensioned after the application of 2% prestrain. The bake hardening amount difference ABH is the absolute value of the difference between the BH in a case where the prestrain is 2% and the BH in a case where the prestrain is 1%. In order to satisfy the demand for a reduction in the weight of a vehicle body, the tensile strength is 1300 MPa or more, preferably 1400 MPa or more, and more preferably 1500 MPa or more. Furthermore, the elongation is preferably 5% or more for facilitating forming. In addition, regarding BH, with a BH of less than 180 MPa, it is difficult to perform forming and the strength after forming becomes low. Therefore, a BH of 180 MPa or more is required to provide excellent bake hardenability. The BH is more preferably 200 MPa or more. Regarding ABH, the ABH needs to be 20 MPa or less in order to cause bake hardening to uniformly occur even if there is a difference in the strain amount applied during press forming. The ABH is more preferably 10 MPa or less.

The degree of Si segregation represented by C1/C2 was measured as follows. The manufactured steel sheet was adjusted so that a surface having the rolling direction thereof as a normal direction (that is, a cross section in the thickness direction of the steel sheet) can be observed, the surface was subjected to mirror polishing, and in a range of 100 μm×100 μm in the center portion of the steel sheet in the cross section in the thickness direction of the steel sheet, Si concentrations were measured at 200 points at intervals of 0.5 μm from one surface side toward the other surface side along the thickness direction of the steel sheet by an EPMA device. The same measurement was performed on another four lines so as to cover almost the entire region within the same 100 μm×100 μm range, the highest value among Si concentrations at a total of 1000 points measured on all the five lines was set to the upper limit C1 (mass %) of the Si concentrations, the lowest value was set to the lower limit C2 (mass %) of the Si concentrations, and the ratio C1/C2 was calculated.

In Comparative Example 9, since the annealing time was too short, the martensite structure was formed not over the entire surface, and the TS and BH were similarly low. In Comparative Example 11, since the average cooling rate in the annealing step was too slow, the martensite structure was formed not over the entire surface, and the TS and BH were low. In Comparative Example 12, since the holding temperature in the heat treatment step was too high, the iron carbide became coarse, the TS and BH were low, and the

TABLE 3

| | Mechanical property value | | | | Steel structure | | | | |
|---|---|---|---|---|---|---|---|---|---|
| No. | TS (MPa) | EL (%) | BH (MPa) | ΔBH (MPa) | Martensite area ratio (%) | Residual γ area ratio (%) | Number density of precipitates (/μm$^2$) | Si concentration ratio C1/C2 | Note |
| 1 | 1702 | 8.4 | 221 | 3 | 99 | 1 | 52 | 1.15 | Example |
| 2 | 1756 | 7.8 | **156** | **30** | 98 | 2 | **10** | 1.18 | Comparative Example |
| 3 | 1821 | 6.9 | 229 | 11 | 98 | 2 | 45 | 1.21 | Example |
| 4 | 1398 | 9.6 | 203 | 10 | 100 | 0 | 35 | 1.11 | Example |
| 5 | 1525 | 8.3 | 199 | 5 | 99 | 1 | 42 | 1.12 | Example |
| 6 | 1759 | 5.8 | **156** | **23** | 99 | 1 | **12** | 1.18 | Comparative Example |
| 7 | 1569 | 7.9 | 257 | 8 | 99 | 1 | 46 | 1.14 | Example |
| 8 | **441** | 30.2 | **64** | 15 | **45** | 0 | 32 | 1.15 | Comparative Example |
| 9 | **1040** | 18.5 | **95** | 18 | **65** | 0 | 35 | 1.21 | Comparative Example |
| 10 | 1741 | 8.2 | 209 | 6 | 99 | 1 | 46 | 1.17 | Example |
| 11 | **989** | 18.5 | **92** | 19 | **64** | 0 | 38 | 1.14 | Comparative Example |
| 12 | **1122** | 13.2 | **52** | **22** | 98 | 2 | **13** | 1.13 | Comparative Example |
| 13 | **1164** | 13.4 | **161** | 10 | 100 | 0 | 37 | 1.12 | Comparative Example |
| 14 | 1301 | 9.7 | **139** | **35** | 100 | 0 | **0** | 1.19 | Comparative Example |
| 15 | 1699 | 8.4 | 231 | 12 | 99 | 1 | 42 | 1.17 | Example |
| 16 | 1723 | 8.3 | 181 | **45** | 99 | 1 | 40 | **1.45** | Comparative Example |
| 17 | 1692 | 8.3 | 230 | **40** | 99 | 1 | 41 | **1.55** | Comparative Example |
| 18 | 1768 | 7.9 | 225 | 8 | 98 | 2 | 46 | 1.12 | Example |
| 19 | **590** | 25.6 | **71** | 2 | **11** | 0 | **0** | 1.13 | Comparative Example |
| 20 | 1421 | 9.2 | 215 | 12 | 99 | 1 | 38 | 1.15 | Example |
| 21 | 1489 | 9.0 | 189 | **35** | 99 | 1 | 36 | **1.68** | Comparative Example |
| 22 | 2489 | **4.0** | **156** | 11 | **92** | **8** | 56 | 1.21 | Comparative Example |
| 23 | 1601 | 9.6 | 199 | 10 | 99 | 1 | 42 | 1.19 | Example |
| 24 | 1599 | 9.5 | 189 | **35** | 99 | 1 | 43 | **1.35** | Comparative Example |
| 25 | 1622 | 9.0 | 216 | 9 | 99 | 1 | 41 | 1.12 | Example |
| 26 | 1627 | 8.9 | 201 | **42** | 99 | 1 | 45 | **1.41** | Comparative Example |
| 27 | 1633 | 8.8 | 191 | **50** | 99 | 1 | 41 | **1.56** | Comparative Example |
| 28 | 1709 | 8.4 | 224 | 7 | 98 | 2 | 49 | 1.13 | Example |
| 29 | 1698 | 8.5 | 181 | **23** | 99 | 1 | 42 | **1.45** | Comparative Example |
| 30 | 1695 | 8.6 | **175** | **25** | 98 | 2 | **25** | 1.21 | Comparative Example |
| 31 | 1476 | 9.5 | 189 | 11 | 99 | 1 | 38 | 1.19 | Example |
| 32 | 1501 | 8.4 | 199 | **32** | 99 | 1 | 45 | **1.56** | Comparative Example |
| 33 | **1189** | 10.5 | **161** | **35** | 99 | 1 | **20** | 1.13 | Comparative Example |
| 34 | 1562 | 7.7 | 220 | 13 | 99 | 1 | 44 | 1.21 | Example |

Bold underline indicates outside of the range of the present invention or outside of the desirable range.

[Evaluation Results]

As shown in Table 3, in Examples 1, 3 to 5, 7, 10, 15, 18, 20, 23, 25, 28, 31, and 34, excellent tensile strength, BH, and ABH could be obtained. In all the cases, the tensile strength was 1300 MPa or more, the BH was 180 MPa or more, and the ABH was 20 MPa or less, so that it was shown that the strength was high and the bake hardenability was excellent. In the high-strength steel sheets according to these examples, precipitates, particularly iron carbide, were uniformly precipitated on the entire surface within the lath in martensite.

On the other hand, in Comparative Example 2, since the retention time in the heat treatment step was short, desired iron carbide was not sufficiently precipitated, the BH was low, and the ABH was high. In Comparative Example 6, since the holding temperature in the heat treatment step was low, desired iron carbide was not sufficiently precipitated, the BH was low, and the ABH was high. In Comparative Example 8, since the annealing temperature was too low, a ferrite structure appeared, a sufficient martensite structure was not obtained, and as a result, the TS and BH were low. ABH was high. In Comparative Example 13, since the C content was too small, the amount of solid solution carbon decreased, and the TS and BH were low. In Comparative Example 14, since the Si content was too small, desired iron carbide was not sufficiently formed, the BH was low, and the ABH was high.

In Comparative Example 16, since the difference in the rolling reduction between the two passes during one reciprocation in the rough rolling step was large, a structure with a uniform Si concentration distribution was not formed, and the ABH was high. In Comparative Example 17, since the rolling reduction in the even-numbered pass during one reciprocation in the rough rolling step was smaller than the rolling reduction in the odd-numbered pass, a structure with a uniform Si concentration distribution was not formed, and the ABH was high. In Comparative Example 19, since the Mn content was too low, the TS and BH were low. In Comparative Example 21, since the rolling reduction of the reverse rolling in the rough rolling step was high, a structure with a uniform Si concentration distribution was not formed, and the ABH was high. In Comparative Example 22, since the C content was too high, the area ratio of residual austenite (γ) was high, a sufficient martensite structure was not obtained, and the BH was low. In Comparative Example 24, the time from the rough rolling to the finish rolling was too short, a structure with a uniform Si concentration distribution was not formed, and the ABH was high. In Comparative Example 26, since the number of stands for the finish rolling was small, the Si concentration distribution became flat, and the ABH was high. In Comparative Example 27, the rolling reduction of the first stand in the finish rolling was small, the Si concentration distribution became flat, and the ABH was high. In Comparative Example 29, since the finish rolling temperature (finish rolling start temperature in Table 2) was too high, the Si concentration portion distribution became flat, and the ABH was high. In Comparative Example 30, since the cold-rolling reduction was too high, a carbide having a desired aspect ratio could not be obtained, the BH was low, and the ABH was high. In Comparative Example 32, since the number of passes of reverse rolling in the rough rolling step was an odd number, a structure with a uniform Si concentration distribution was not formed, and the ABH was high. In Comparative Example 33, since the cooling stop temperature in the annealing step was high, spheroidized coarse iron carbide was precipitated, the TS and BH were low, and the ABH was high.

INDUSTRIAL APPLICABILITY

The high-strength steel sheet having excellent bake hardenability according to the present invention can be used as an original plate of a structural material for a vehicle, particularly in an automotive industry field.

BRIEF DESCRIPTION OF THE REFERENCE SYMBOLS

1 Uniform structure
2 Prior austenite grain boundary
3 Lath structure
4 Lath
5 Precipitate

What is claimed is:

1. A high-strength steel sheet comprising, by mass %:
C: 0.13% to 0.40%;
Si: 0.500% to 3.000%;
Mn: 2.50% to 5.00%;
P: 0.100% or less;
S: 0.010% or less;
Al: 0.001% to 2.000%;
N: 0.010% or less;
Ti: 0 to 0.100%;
Nb: 0 to 0.100%;
V: 0 to 0.100%;
Cu: 0 to 1.000%;
Ni: 0 to 1.000%;
Mo: 0 to 1.000%;
Cr: 0 to 1.000%;
W: 0 to 0.005%;
Ca: 0 to 0.005%;
Mg: 0 to 0.005%;
a rare earth metal (REM): 0 to 0.010%;
B: 0 to 0.0030%; and
a remainder comprising Fe and impurities,
wherein martensite is 95% or more in an area ratio, and a residual structure is 5% or less in an area ratio,
a ratio C1/C2 of an upper limit C1, in mass %, of Si concentrations to a lower limit C2, in mass %, of the Si concentrations in a cross section in a thickness direction is 1.25 or less,
precipitates having a major axis of 0.05 μm or more and 1.00 μm or less and an aspect ratio of 1:3 or more are included in a number density of $30/\mu m^2$ or more, and
a tensile strength is 1300 MPa or more.

2. The high-strength steel sheet according to claim 1,
wherein, in a case where the residual structure is present, the residual structure is formed of residual austenite.

3. The high-strength steel sheet according to claim 1, comprising, by mass %, one or two or more of:
Ti: 0.100% or less;
Nb: 0.100% or less; and
V: 0.100% or less,
in a total amount of 0.100% or less.

4. The high-strength steel sheet according to claim 1, comprising, by mass %, one or two or more of:
Cu: 1.000% or less;
Ni: 1.000% or less:
Mo: 1.000% or less; and
Cr: 1.000% or less,
in a total amount of 1.000% or less.

5. The high-strength steel sheet according to claim 1, comprising, by mass %, one or two or more of:
W: 0.005% or less;
Ca: 0.005% or less;
Mg: 0.005% or less; and
a rare earth metal (REM): 0.010% or less,
in a total amount of 0.010% or less.

6. The high-strength steel sheet according to claim comprising, by mass %, one or two or more of:
Ti: 0.100% or less;
Nb: 0.100% or less; and
V: 0.100% or less,
in a total amount of 0.100% or less.

7. The high-strength steel sheet according to claim 2, comprising, by mass %, one or two or more of:
Cu: 1.000% or less;
Ni: 1.000% or less;
Mo: 1.000% or less; and
Cr: 1.000% or less,
in a total amount of 1.000% or less.

8. The high-strength steel sheet according to claim 2, further comprising, by mass %, one or two or more of:
W: 0.005% or less;
Ca: 0.005% or less;
Mg: 0.005% or less; and
a rare earth metal (REM): 0.010% or less,
in a total amount of 0.010% or less.

* * * * *